US006428632B1

(12) United States Patent
Fujiyama et al.

(10) Patent No.: US 6,428,632 B1
(45) Date of Patent: Aug. 6, 2002

(54) NON-ORIENTED ELECTROMAGNETIC STEEL SHEET HAVING REDUCED MAGNETIC ANISOTROPY IN HIGH FREQUENCY REGION AND EXCELLENT PRESS WORKABILITY

(75) Inventors: Toshiro Fujiyama; Keiji Sakai, both of Kurashiki (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/889,907

(22) PCT Filed: Nov. 21, 2000

(86) PCT No.: PCT/JP00/08220

§ 371 (c)(1),
(2), (4) Date: Jul. 24, 2001

(87) PCT Pub. No.: WO01/38595

PCT Pub. Date: May 31, 2001

(30) Foreign Application Priority Data

Nov. 26, 1999 (JP) ..... 11-335597

(51) Int. Cl.[7] ..... H01F 1/147
(52) U.S. Cl. ..... 148/307; 420/117
(58) Field of Search ..... 148/307, 308; 420/117

(56) References Cited

U.S. PATENT DOCUMENTS 4,046,602 A * 9/1977 Stanley ..... 148/111
5,258,080 A * 11/1993 Burger et al. ..... 148/307
5,306,356 A * 4/1994 Brissinneau et al. ..... 148/308

FOREIGN PATENT DOCUMENTS

JP 53-66816 6/1978
JP 54-68716 6/1979
JP 55-073819 6/1980
JP 58-025427 2/1983
JP 61-087823 5/1986
JP 3-274247 12/1991
JP 3-294422 12/1991
JP 4-063252 2/1992
JP 4-136138 5/1992
JP 7-18335 1/1995
JP 8-246108 9/1996
JP 9-157804 6/1997
JP 11-124626 5/1999

* cited by examiner

*Primary Examiner*—John Sheehan
(74) *Attorney, Agent, or Firm*—Schnader Harrison Segal & Lewis LLP

(57) ABSTRACT

According to the invention, a nonoriented electromagnetic steel sheet being small in the magnetic anisotropy in a high frequency zone and thus excellent in the magnetic properties as a rotating machine and having an excellent press formability such as punching property or the like can be obtained stably by adjusting a chemical composition of the oriented electromagnetic steel sheet to a given range, and establishing the following equation (1) between L, C average iron loss $W_{15/50}$(L+C)[W/kg] and L, C average magnetic flux density $B_{50}$(L+C)[T] with respect to measured values of magnetic properties using Epstein test pieces:

$$B_{50}(L+C) \geqq 0.03 \cdot W_{15/50}(L+C) + 1.63 \quad (1)$$

and satisfying a ratio of D iron loss $W_{10/400}$(D)[W/kg] to L, C average iron loss $W_{10/400}$(L+C)[W/kg] by the following equation (2):

$$W_{10/400}(D)/W_{10/400}(L+C) \leqq 1.2 \quad (2)$$

and defining a hardness of the steel sheet in accordance with a sheet thickness and $W_{15/50}$(L+C).

5 Claims, 5 Drawing Sheets

NON-ORIENTED ELECTROMAGNETIC STEEL SHEET HAVING REDUCED MAGNETIC ANISOTROPY IN HIGH FREQUENCY REGION AND EXCELLENT PRESS WORKABILITY

TECHNICAL FIELD

This invention relates to a nonoriented electromagnetic steel sheet suitable for use in mostly rotating machines such as motor or the like and small-size power transducer and so on.

Particularly, the invention is intended to reduce a magnetic anisotropy in a high frequency zone to improve magnetic properties and to decrease a hardness at an iron loss equal to the conventional products to advantageously improve a blanking property in the pressing.

BACKGROUND ART

Recently, it is increasingly intended to increase the efficiency of electrical equipments accompanied with the increase in the demand for energy saving. In order to cope with such a demand, steel sheet makers make efforts for improving iron loss properties of electromagnetic steel sheets for electrical equipments by various means as mentioned later.

The addition of Si to the electromagnetic steel sheet is a most effective means for enhancing a specific resistance of the steel sheet to reduce the iron loss. This technique of reducing the iron loss by the Si addition is widely used in the field of the electromagnetic steel sheets. And also, Al is known to have the effect similar to Si as an additional element.

For example, JP-A-53-66816 proposes a positive addition of Al for enhancing the specific resistance of the steel sheet and avoiding the function of suppressing the grain growth through the precipitation of fine AlN.

And also, JP-A-55-73819 attains good magnetic properties at high magnetic field by adding Al and adjusting an annealing atmosphere to decrease an internal oxide layer on a surface of a steel sheet.

Furthermore, JP-A-54-68716 and JP-A-58-25427 reduce the iron loss by adding Al and co-adding REM and Sb or purifying to improve a texture.

Besides, JP-A-61-87823 attains the improvement of magnetic properties by adding Al and controlling a cooling rate of steel sheet in the final annealing. JP-A-3-274247 attains the improvement of magnetic properties by adding Al and co-adding B, Sb and Sn to prevent oxidation and nitriding. JP-A-3-294422 attains the improvement of magnetic properties by adding Al and controlling cold rolling to reduce a ratio of L, C characteristics of the steel sheet. JP-A-4-63252 attains the improvement of magnetic properties by co-adding Mn and Al. JP-A-4-136138 attains the improvement of magnetic properties by adding Al and extremely reducing Si and adding P, Sb to improve a texture.

All of the aforementioned techniques improve the properties of the electromagnetic steel sheet itself to bring about the improvement of the efficiency of the electrical equipments using such an electromagnetic steel sheet.

On the other hand, a technique of controlling a small-size rotating machine is recently and rapidly advanced by remarkable improvement of techniques surrounding semiconductors with the improvement of performances of the semiconductor and the lowering of cost thereof, and rotation control is carried out through an inverter. And also, it is possible to manufacture a high-efficiency rotating machine such as DC brushless motor or the like with the improvement of permanent magnet materials.

However, the driving conditions of the motor are complicated with the advance of the technique of controlling the small-size rotating machine or the improvement of the permanent magnet materials, and hence an exciting condition at not only high rotating zone but also low rotating zone becomes contain a great amount of high frequency components based on strain or the like. Since a great amount of the high frequency components is contained, it is difficult to reduce the iron loss to a certain level in an iron core of a motor using the above conventional materials, and the improvement of the efficiency in the motor is reaching the ceiling.

In addition, when a content of a specific resistance element such as Si, Al or the like is increased for reducing the iron loss, the hardness of the steel sheet rises, which has problems that the life of the mold in the press forming of motor or transformer is lowered and defective blanking is increased.

DISCLOSURE OF THE INVENTION

It is an object of the invention to propose a nonoriented electromagnetic steel sheet for a rotating machine capable of more enhancing an efficiency of a high-efficiency rotating machine and having a small magnetic anisotropy in a high frequency zone.

It is another object of the invention to propose a nonoriented electromagnetic steel sheet also improving a press formability to have a small magnetic anisotropy in a high frequency zone and an excellent press formability.

The inventors have not only examined the magnetic properties of various electromagnetic steel sheets in detail, but also actually prepared rotating machines (motors) by using these electromagnetic steel sheets and made various studies with respect to a relation between actual properties and material properties in these motors. As a result, the inventors have found that it is very important to make small a magnetic anisotropy of a raw material in a high frequency zone rather than a commercial frequency for enhancing the efficiency of the actual motor.

And also, the inventors have found that it is effective to restrict the hardness of the steel sheet to an adequate range in accordance with the value of iron loss in order to prevent the degradation of the magnetic properties feared in the press forming such as blanking or the like.

The invention is based on the above knowledge.

The gist and construction of the invention are as follows.

1. A nonoriented electromagnetic steel sheet having a small magnetic anisotropy in a high frequency zone and an excellent press formability, characterized in that it has a composition containing C: not more than 0.0050 mass %, Si: 0.5–4.5 mass %, Mn: 0.1–2.5 mass % and Al: 0.2–2.5 mass % and controlling S: not more than 0.01 mass %, and that as to magnetic properties in rolling direction (L-direction), direction perpendicular to the rolling direction (C-direction) and direction inclined at an angle of 45° with respect to the rolling direction (D-direction) using an Epstein test piece, L, C average iron loss $W_{15/50}$(L+C) [W/kg] at 1.5 T and 50 Hz and L, C average magnetic flux density $B_{50}$(L+C)[T] at 5000 A/m satisfy a relation of the following equation (1):

$$B_{50}(L+C) \geqq 0.03 \cdot W_{15/50}(L+C) + 1.63 \quad (1)$$

and a ratio of D iron loss $W_{10/400}$(D)[W/kg] to L, C average iron loss $W_{10/400}$(L+C)[W/kg] at 1.0 T and 400 Hz satisfies a relation of the following equation (2):

$$W_{10/400}(D)/W_{10/400}(L+C) \leqq 1.2 \quad (2)$$

and that a hardness of the steel sheet is defined in accordance with a sheet thickness and $W_{15/50}$(L+C).

2. A nonoriented electromagnetic steel sheet having a small magnetic anisotropy in a high frequency zone and an excellent press formability according to the above item 1, wherein the hardness of the steel sheet is defined in accordance with a sheet thickness and $W_{15/50}$(L+C).
3. A nonoriented electromagnetic steel sheet having a small magnetic anisotropy in a high frequency zone and an excellent press formability according to the above item 2, wherein the hardness of the steel sheet $Hv_1$ (JIS Z2244, test load: 9.807 N) satisfies a relation of the following equation (3):

$$Hv_1 \leqq -83.3 \cdot W_{15/50}(L+C)+380 \quad (3)$$

within a range of iron loss of $W_{15/50}$(L+C)≦5.0 W/kg and at a sheet thickness of 0.35 mm±0.02 mm.

4. A nonoriented electromagnetic steel sheet having a small magnetic anisotropy in a high frequency zone and an excellent press formability according to the above item 2, wherein the hardness of the steel sheet $Hv_1$ (JIS Z2244, test load: 9.807 N) satisfies a relation of the following equation (4):

$$Hv_1 \leqq -63.6 \cdot W_{15/50}(L+C)+360 \quad (4)$$

within a range of iron loss of $W_{15/50}$(L+C)≦5.0 W/kg and at a sheet thickness of 0.50 mm±0.02 mm.

5. A nonoriented electromagnetic steel sheet having a small magnetic anisotropy in a high frequency zone and an excellent press formability according to any one of the above items 1–4, wherein the steel sheet further contains Sb: 0.005–0.12 mass %.

The invention will concretely be described below.

At first, the inventors have get commercially available DC brushless motors and prepared dies capable of working into the same shapes of rotors and stators of these DC brushless motors. Then, the inventors have manufactured various motors by punching out various steel sheet materials into given shapes with such dies.

Moreover, in the evaluation of properties of these materials, the measurement of magnetic properties is carried out with respect to not only conventional Epstein test pieces in the rolling direction and the direction perpendicular to the rolling direction (L-piece, C-piece) but also Epstein test piece in a direction inclined at an angle of 45° with respect to the rolling direction (D-piece). And also, the measurement of the magnetic properties is carried out at not only commercial frequency but also a high frequency zone up to 50 kHz. Now, the inventors have analyzed and investigated these measured results in detail.

In FIG. 1 are shown results examined on influences of iron loss and magnetic flux density of materials upon motor efficiency. Moreover, the motor efficiency is represented by ○: more than 92%, Δ: 89–92%, and X: less than 82%.

As shown in the above figure, it has been confirmed that the motor efficiency of more than 92% is obtained when L, C average iron loss $W_{15/50}$(L+C)[W/kg] at 1.5 T and 50 Hz and L, C average magnetic flux density $B_{50}$(L+C)[T] at 5000 A/m in the material satisfy a relation of the following equation (1):

$$B_{50}(L+C) \geqq 0.03 \cdot W_{15/50}(L+C)+1.63 \quad (1)$$

However, even if the condition of the above equation is satisfied, all materials do not necessarily attain the high efficiency of more than 92%.

Now, the inventors have made further detailed studies with respect to properties in high frequency zone, properties every angle and analysis of strain wave in order to clarify the cause.

The obtained results are shown in FIG. 2.

Moreover, all materials used in the above experiment satisfy the condition of the above equation (1). In this case, $W_{10/400}$(L+C)[W/kg] and $W_{10/400}$(D)[W/kg] are an average of iron loss values in the rolling direction (L-direction) of the material and the direction perpendicular to the rolling direction (C-direction) and an iron loss value in a direction inclined at an angle of 45° with respect to the rolling direction (D-direction) at 1.0 T and 400 Hz, respectively.

As seen from the above figure, it has been found that good motor efficiency is stably obtained when the ratio satisfies only the relation of the following equation (2):

$$W_{10/400}(D)/W_{10/400}(L+C) \leqq 1.2 \quad (2)$$

The reason why the good motor efficiency is obtained only by using materials satisfying the conditions of the equations (1) and (2) according to the invention as mentioned above is not necessarily clear, but can be guessed as follows.

That is, the motor efficiency becomes higher as iron loss and copper loss of the motor are smaller. The iron loss is mainly influenced by the iron loss of the material, so that a motor having a low iron loss is obtained by using a material having a low iron loss. On the other hand, the copper loss is influenced by the magnetic flux density of the material, so that as the magnetic flux density becomes higher, a permeability becomes high and current required for exciting becomes small and hence joule loss or copper loss generated is reduced.

However, the properties of the material are usually characteristics measured under an ideal sign wave exciting, while characteristics of actual device are influenced by complicated shape of motor and magnetic path and hence a magnetic flux waveform is distorted and a high frequency component is existent. Recently, an inverter control is used for increasing the efficiency, and it is possible to change a rotating number by a change of a frequency. As for the inverter frequency, not only the carrier frequency is a high frequency, but relatively high frequency is also used as the basic frequency.

Thus, the actual motor efficiency is influenced by a high frequency component in the magnetic properties, which has never been considered in the evaluation of the usual material.

And also, the evaluation of the usual material is mainly an evaluation only for L, C test pieces, while magnetic flux flows in all directions of electromagnetic steel sheet used in the motor (all directions in the sheet inclusive of a D-direction inclined at 45° with respect to the rolling direction).

Therefore, the improvement of the motor efficiency within the scope of the invention is considered due to the fact that the properties in the D-direction particularly low magnetic field, high frequency property relatively take an important role in the inside of the motor.

Then, the inventors have made examined an influence of punching upon the magnetic properties.

Two kinds of test pieces of 30 mm×280 mm and 7.5 mm×280 mm are sampled by punching steel sheets of various materials (sheet thickness: 0.35 mm) used in the manufacture of the above motors. With respect to the size of 7.5 mm×280 mm among these test pieces, the magnetic properties are measured by Epstein test after four test pieces are arranged side by side. In this test, test pieces punched out in the rolling direction and the direction perpendicular to the rolling direction as a longitudinal direction are used and average iron loss thereof is measured.

Among the materials used, a tendency of degrading the iron loss is examined with respect to the test piece having a width of 7.5 mm against the test piece having a width of 30 mm in the material not satisfying the conditions of the equations (1) and (2) to obtain results shown in FIG. 3 as a relation between hardness $Hv_1$ and iron loss $W_{15/50}(L+C)$ of the material. In this case, a value of iron loss $W_{15/50}(L+C)$ as an abscissa is represented by the measured results of the material having a size of 30 mm×280 mm. And also, the degradation of iron loss is represented by ○: less than 8%, Δ: 8–10% and X: more than 10%.

As seen from the above figure, when the degradation of iron loss is more than 10%, at least a degrading tendency is recognized with the increase of the hardness, but a special tendency is not recognized with respect to the iron loss $W_{15/50}(L+C)$.

When the same examination is carried out with respect to the materials satisfying the conditions of the equations (1) and (2), as shown in FIG. 4, it has turned out that as the iron loss $W_{15/50}(L+C)$ becomes lower, the hardness of the material having a width of 7.5 mm at a limit of degrading the iron loss to more than 10% becomes higher.

As seen from the above figure, it has got clear that the degradation of iron loss by punching can be mitigated when satisfying the following equation (3):

$$Hv_1 \leqq -83.3 \cdot W_{15/50}(L+C)+380 \quad (3)$$

Furthermore, the inventors have made the measurement of magnetic properties with respect to the material having a sheet thickness of 0.50 mm in the same manner as in the material having a sheet thickness of 0.35 mm.

The results are shown in FIG. 5. As seen from this figure, it has got clear that the degradation of iron loss by punching can be mitigated when satisfying the following equation (4):

$$Hv_1 \leqq -63.6 \cdot W_{15/50}(L+C)+360 \quad (4)$$

Although the reason is not necessarily clear, the inventors consider as follows:

The degradation of the magnetic properties by punching is due to the fact that an influence of distortion through deformation in the shearing of the punched end face is large. This deformation degree is considered to be affected by crystal grain size and texture of the material. In general, it is considered that the punching property becomes poor as the hardness increases, but the hardness at the limit of degrading the magnetic properties after the punching is increased by getting appropriate crystal grain size or texture. While the iron loss $W_{15/50}$ is influenced by the crystal grain size or texture, as the iron loss $W_{15/50}$ becomes lower, the crystal grain size or texture becomes more appropriate into a good state for the punching property.

The dependency of the limit hardness for the good punching property upon the iron loss $W_{15/50}$ becomes remarkable when the material satisfies the equations (1) and (2). That is, as the magnetic anisotropy becomes smaller, the difference in the punching property based on the difference of shearing direction (i.e. difference in the degradation of iron loss) becomes smaller. As a result, the influence of the crystal grain size or texture upon the punching property becomes relatively larger. Therefore, it is considered that the range of the hardness for the good punching property is represented by the equation (3) or (4).

Then, the reason why the composition of the material is limited to the above range will be described.

C: not more than 0.0050 mass %

C not only enlarges γ-region to lower α-γ transformation point but also suppresses growth of α grains due to the formation of film-shaped γ-phase at α grain boundary during the annealing, so that it is necessary to basically lessen C. Further, there is a fear that even when γ-phase is not produced at a full temperature region because a greater amount of α-phase stabilizing element such as Si or Al is contained, if the C content exceeds 0.0050 mass %, the aging degradation of iron loss properties is caused.

Therefore, the C content is restricted to not more than 0.0050 mass % in the invention.

Si: 0.5–4.5 mass %

Since Si is an element useful for enhancing a specific resistance of steel and lowering an iron loss, 0.5 mass % is required at the minimum for obtaining such effects. However, the excessive addition of Si raises the hardness to degrade cold rolling property, so that the upper limit of Si is 4.5 mass %.

Al: 0.2–2.5 mass %

Al acts to enhance the specific resistance of steel and lower the iron loss likewise Si, so that it is added in an amount of not less than 0.2 mass %. However, as the Al content becomes larger, the lubricity to a mold in the continuous casting lowers and the casting is difficult, so that the upper limit of Al is 2.5 mass %.

Mn: 0.1–2.5 mass %

Mn has an action enhancing the specific resistance of steel and lowering the iron loss, which is smaller than that of Si and Al, and effectively contributes to improve hot rolling property. However, when the Mn content is less than 0.1 mass %, the addition effect is poor, while when the Mn content is too large, the cold rolling property is degraded, so that the upper limit of Mn is 2.5 mass %.

S: not more than 0.01 mass %

S forms a precipitate or an inclusion to obstruct grain growth, so that it is necessary to reduce the incorporation of S as far as possible. The incorporation of S is acceptable to be not more than 0.01 mass %.

Essential elements and elements which should be controlled have been explained. Besides them, following elements can be added if demanded.

Sb: 0.005–0.12 mass %

Sb not only improves the texture to improve the magnetic flux density but also suppresses oxidation and nitriding of a surface layer of the steel sheet, particularly aluminum and hence suppresses the formation of fine grains in the surface layer. Thus, the rise of surface hardness is suppressed by controlling the formation of fine grains in the surface layer to improve the punching formability. However, when the Sb content is less than 0.005 mass %, the addition effect is poor, while when it exceeds 0.12 mass %, the grain growth is obstructed to degrade the magnetic properties, so that the Sb content is restricted to a range of 0.005–0.12 mass %.

P: not more than 0.1 mass %

P also has an effect of enhancing the specific resistance of steel and lowering the iron loss, which is smaller than that of Si or Al, and improves the texture after cold rolling and recrystallization through grain boundary segregation to improve the magnetic flux density, so that P may be added, if necessary. However, excessive grain boundary segregation of P obstructs the grain growth to degrade the iron loss, so that the upper limit of P is 0.1 mass %.

Since Ni, Cu, Cr and the like are other elements for enhancing the specific resistance, they may be added, but when each of them exceeds 10 mass %, the rolling property is degraded, so that they are preferable to be added in an amount of not more than 10 mass %.

Next, preferable production conditions according to the invention will be described.

The hot rolling condition is not particularly defined, but it is desirable that a heating temperature of a slab is not higher than 1200° C. for energy saving.

When the annealing of the hot rolled sheet is lower than 800° C., it is difficult to improve the magnetic flux density, so that such an annealing is favorable to be carried out at a temperature region of not lower than 800° C.

Then, it is subjected to a cold rolling or twice cold rolling including an intermediate annealing. In the cold rolling, it is favorable to conduct a rolling reduction of at least 20% at a temperature region of not lower than 50° C. to get appropriate texture.

That is, it is elucidated that <100> as an axis of easy magnetization is ideal to direct in a D-direction for improving the iron loss in the D-direction at relatively low magnetic field and high frequency zone, but that it is favorable to include <111> as an axis of hard magnetization to a certain extent.

And it is important that it is subjected to a rolling reduction of at least 20% at a temperature region of not lower than 50° C. in the cold rolling for obtaining the above texture.

Although the reason is not clear, it is guessed to result from a magnetic domain structure.

If the rolling temperature is lower than 50° C. or the rolling reduction is less than 20%, the formation of D//<111> is insufficient and the good D properties are not obtained.

Moreover, such a rolling may be attained by Sendzimir rolling, but is favorable to be carried out by Tandem rolling from a viewpoint of a production efficiency.

The final annealing is favorable to be carried out above 850° C. because if the temperature is lower than 850° C., the grain growth is insufficient and good L, C, D iron losses are not obtained.

BEST MODE FOR CARRYING OUT THE INVENTION

Example 1

Figure 1:
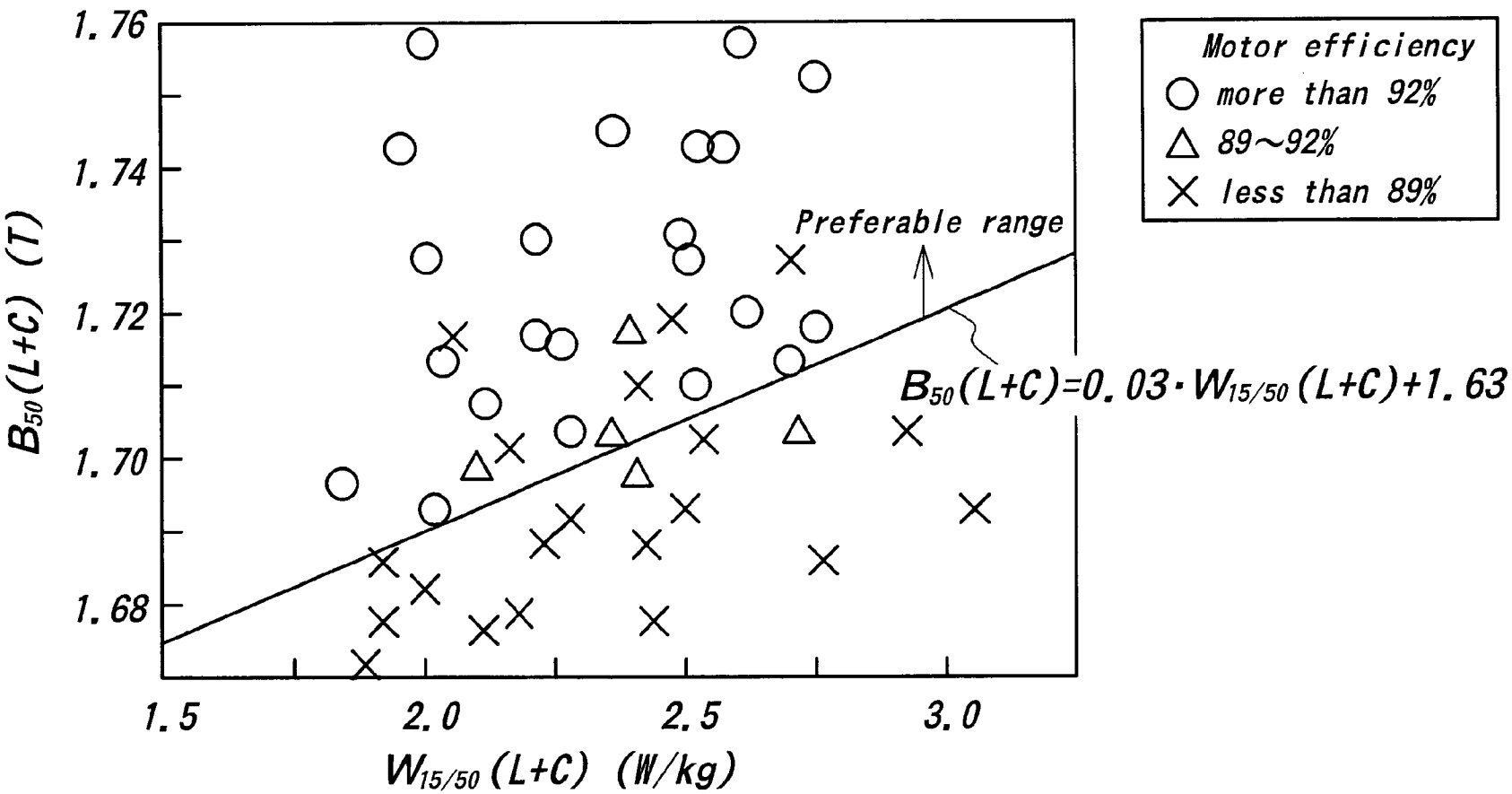
FIG. 1 is a graph showing influences of iron loss $W_{15/50}$(L+C) and magnetic flux density $B_{50}$(L+C) in materials upon motor efficiency.
Figure 2:
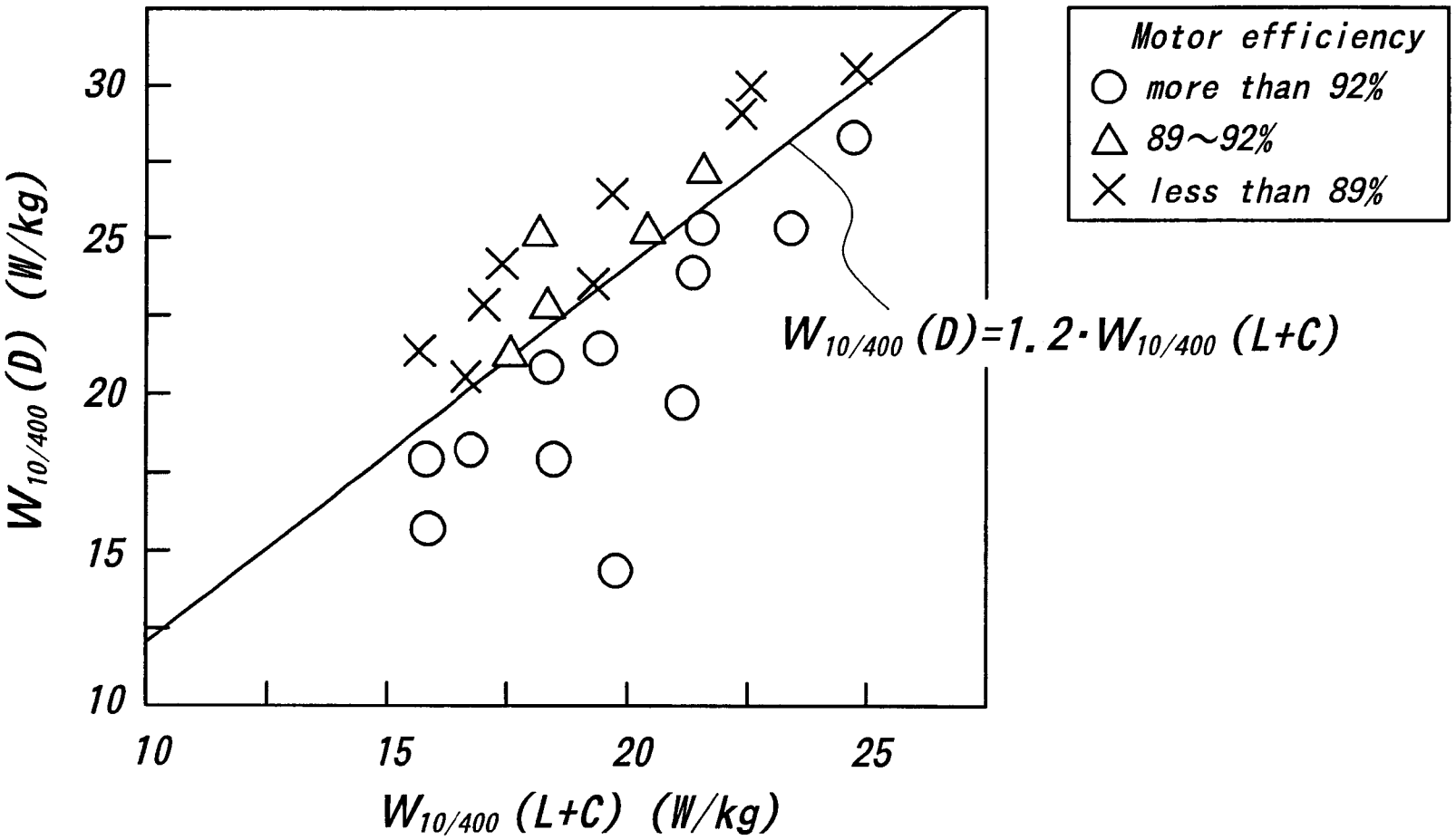
FIG. 2 is a graph showing influence of D-iron loss $W_{10/400}$(D) and L, C average iron loss $W_{10/400}$(L+C) in material upon motor efficiency.
Figure 3:
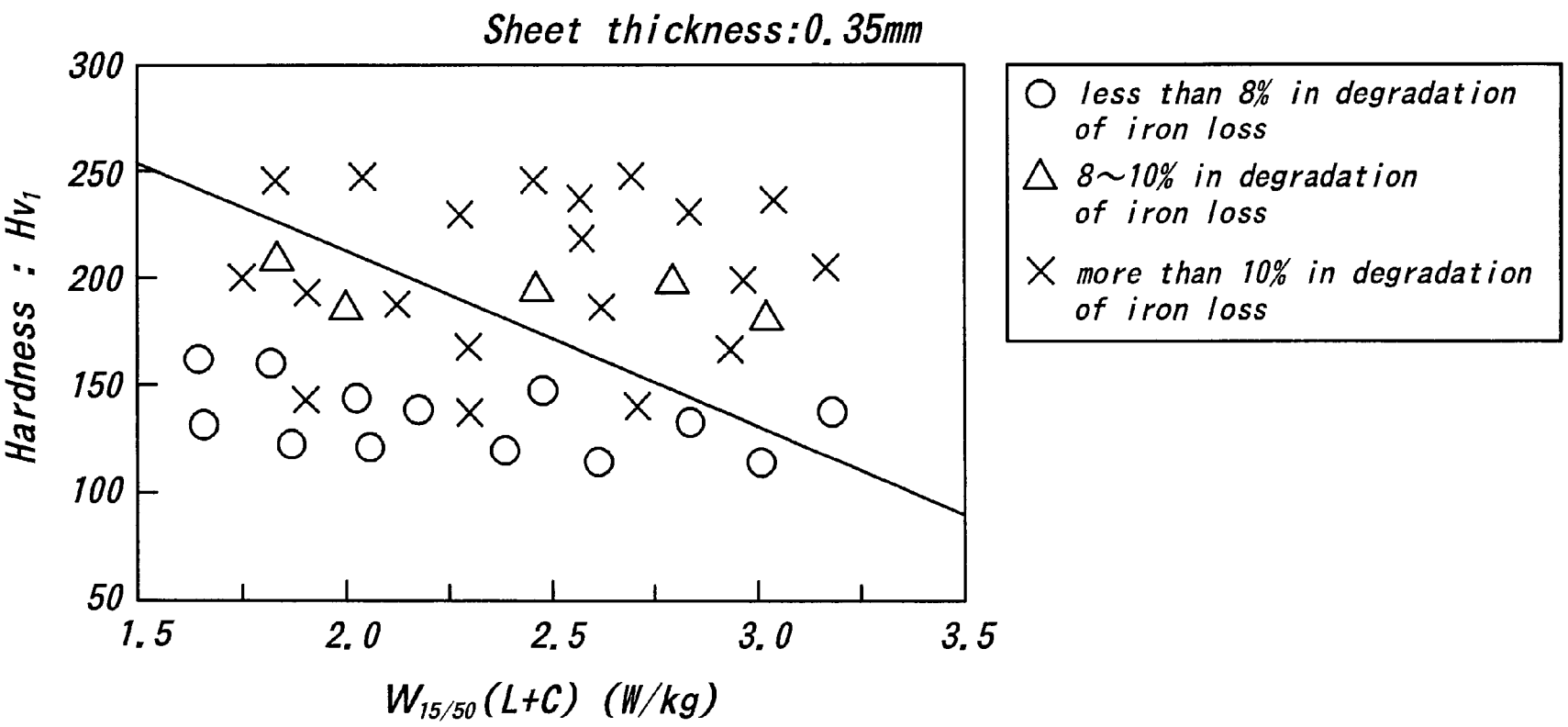
FIG. 3 is a graph showing influences of hardness $Hv_1$ and iron loss $W_{15/50}$(L+C) in materials not satisfying conditions of equations (1) and (2) (sheet thickness: 0.35 mm) upon degradation of iron loss.
Figure 4:
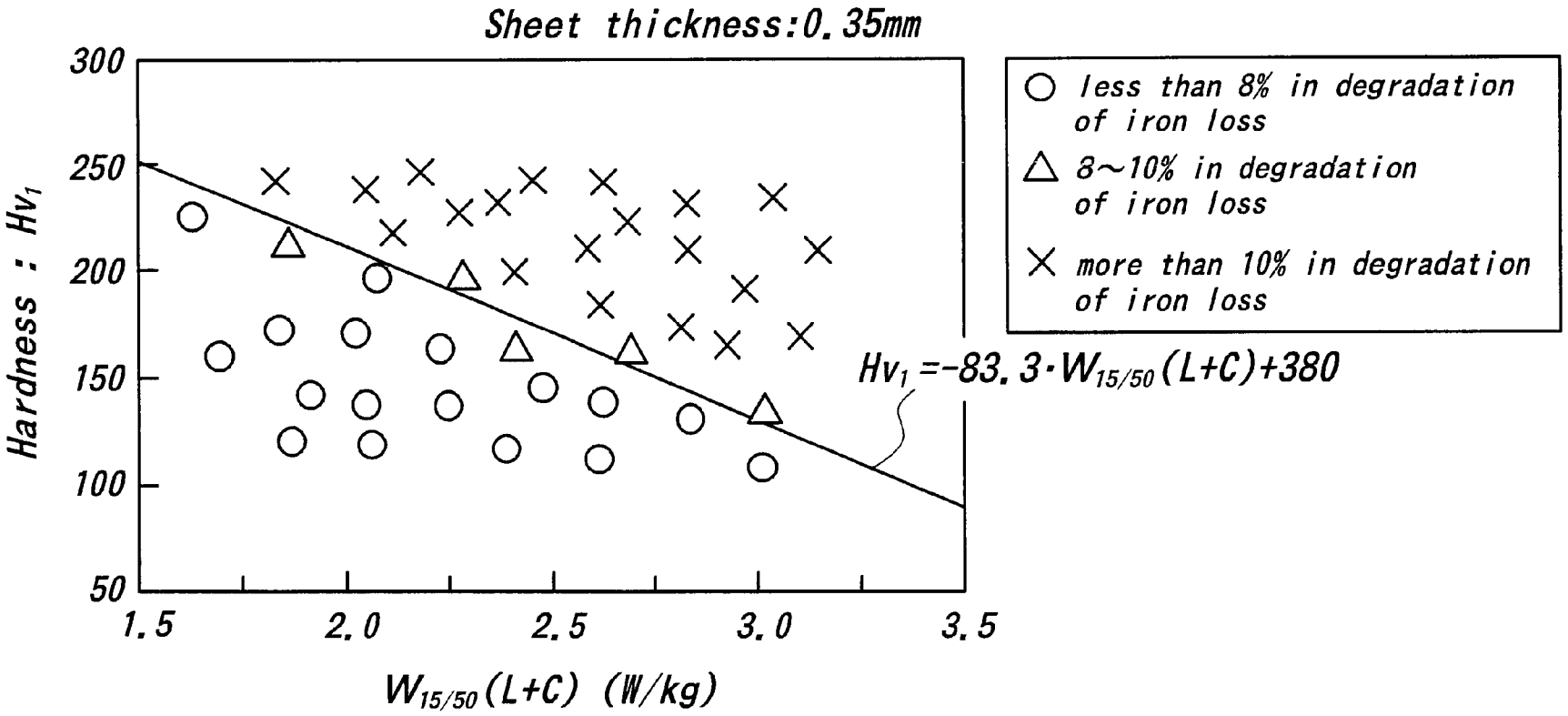
FIG. 4 is a graph showing influences of hardness $Hv_1$ and iron loss $W_{15/50}$(L+C) in materials satisfying conditions of equations (1) and (2) (sheet thickness: 0.35 mm) upon degradation of iron loss.
Figure 5:
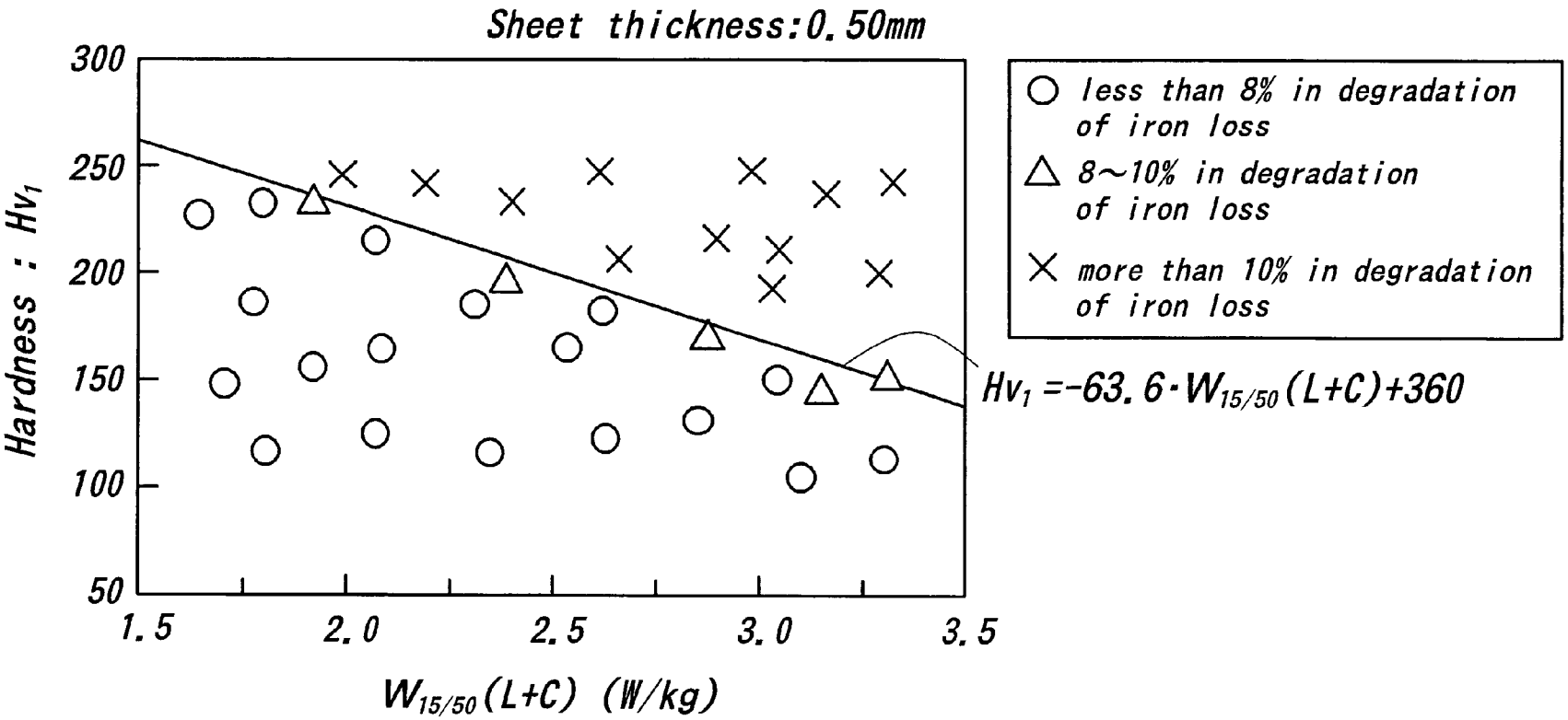
FIG. 5 is a graph showing influences of hardness $Hv_1$ and iron loss $W_{15/50}$(L+C) in materials satisfying conditions of equations (1) and (2) (sheet thickness: 0.50 mm) upon degradation of iron loss.

A steel slab having a chemical composition as shown in Table 1 is heated in a usual gas heating furnace at 1150° C. and hot rolled to obtain a hot rolled sheet having a thickness of 2.6 mm. Then, the hot rolled sheet is annealed at 950° C. for 1 minute and finish-rolled to a thickness of 0.35 mm in a tandem rolling mill of four stands. In this case, a temperature at an entry side of a fourth stand is 80° C. and a rolling reduction is 32%. Then, the rolled sheet is subjected to recrystallization annealing at 950° C. and further to a coating treatment to obtain a product sheet.

Epstein test pieces in L-, C- and D-directions for the evaluation of material are sampled from the thus obtained product sheet to measure magnetic properties. And also, a DC brushless motor of 300 W is prepared to measure a motor efficiency. Furthermore, a hardness of each product sheet $Hv_1$ (JIS Z2244, test load: 9.807 N) is measured.

The thus obtained results are ordered and shown in Table 2.

TABLE 1

| Steel symbol | C (ppm) | Si (mass %) | Mn (mass %) | Al (mass %) | P (mass %) | S (ppm) | Sb (mass %) | Cu (mass %) | Ni (mass %) | Cr (mass %) | Ti (ppm) | O (ppm) | N (ppm) | Remarks |
|---|---|---|---|---|---|---|---|---|---|---|---|---|---|---|
| A | 32 | 2.1 | 0.2 | 0.5 | 0.02 | 25 | 0.05 | 0.01 | 0.02 | 0.01 | 10 | 15 | 22 | Invention Example |
| B | 25 | 1.3 | 0.5 | 1.5 | 0.02 | 35 | tr | 0.01 | 0.01 | 0.01 | 12 | 25 | 25 | Invention Example |
| C | 21 | 1.5 | 0.5 | 1.2 | 0.02 | 15 | tr | 0.02 | 0.05 | 0.01 | 14 | 16 | 14 | Invention Example |
| D | 18 | 1.6 | 1.2 | 0.6 | 0.05 | 20 | tr | 0.05 | 0.01 | 0.02 | 8 | 14 | 15 | Invention Example |
| E | 35 | 0.9 | 1.8 | 1.0 | 0.05 | 14 | tr | 0.08 | 0.02 | 0.01 | 5 | 13 | 18 | Invention Example |
| F | 8 | 2.0 | 0.8 | 1.2 | 0.06 | 10 | tr | 0.10 | 0.01 | 0.03 | 15 | 14 | 19 | Invention Example |
| G | 16 | 2.9 | 0.5 | 0.8 | 0.07 | 7 | tr | 0.01 | 0.01 | 0.01 | 14 | 15 | 25 | Invention Example |
| H | 21 | 2.8 | 0.5 | 0.3 | 0.02 | 2 | 0.02 | 0.01 | 0.02 | 0.01 | 21 | 19 | 24 | Invention Example |
| I | 22 | 0.9 | 0.4 | 0.7 | 0.05 | 15 | 0.03 | 0.01 | 0.01 | 0.01 | 30 | 21 | 15 | Invention Example |
| J | 12 | 0.4 | 1.5 | 0.1 | 0.02 | 10 | tr | 0.01 | 0.01 | 0.01 | 18 | 18 | 18 | Comparative Example |

TABLE 2

| Steel symbol | $W_{15/50}$ (L + C) (W/kg) | 0.03 × $W_{15/50}$ (L + C) +1.63 | $B_{50}$ (L + C) (T) | $W_{10/400}$ (L + C) (W/kg) | $W_{10/400}$ (D) (W/kg) | W (D)/ W (L + C) | Motor efficiency (%) | $Hv_1$ | −83.3 × $W_{15/50}$ (L + C) +380 | Degrading ratio of $W_{15/50}$ (L + C (%)) | Remarks |
|---|---|---|---|---|---|---|---|---|---|---|---|
| A | 2.25 | 1.698 | 1.745 | 18.8 | 19.2 | 1.02 | 94.5 | 162 | 192 | 7.2 | Invention Example |
| B | 2.15 | 1.695 | 1.732 | 18.1 | 19.3 | 1.07 | 93.1 | 168 | 201 | 7.6 | Invention Example |
| C | 2.35 | 1.701 | 1.721 | 18.5 | 19.5 | 1.05 | 93.1 | 152 | 184 | 5.5 | Invention Example |
| D | 2.45 | 1.704 | 1.715 | 20.3 | 21.2 | 1.04 | 92.5 | 143 | 176 | 8.2 | Invention Example |
| E | 2.60 | 1.708 | 1.718 | 19.8 | 21.2 | 1.07 | 92.3 | 130 | 163 | 8.3 | Invention Example |
| F | 2.10 | 1.693 | 1.746 | 16.9 | 18.5 | 1.09 | 92.4 | 177 | 205 | 9.0 | Invention Example |
| G | 1.90 | 1.687 | 1.732 | 17.2 | 18.5 | 1.08 | 93.5 | 205 | 222 | 8.7 | Invention Example |
| H | 1.95 | 1.689 | 1.708 | 18.6 | 19.9 | 1.07 | 94.8 | 190 | 217 | 9.1 | Invention Example |
| I | 2.88 | 1.716 | 1.719 | 21.2 | 23.5 | 1.11 | 94.7 | 110 | 140 | 6.8 | Invention Example |
| J | 3.20 | 1.726 | 1.725 | 24.5 | 29.6 | 1.21 | 87.5 | 115 | 113 | 12.7 | Comparative Example |

As seen from Table 2, according to the invention, materials having a small magnetic anisotropy in a high frequency zone are obtained and hence good motor characteristics are obtained. And also, all of the invention examples have an adequate hardness and are excellent in the press formability.

Example 2

In the manufacture of product sheets using materials of Steel symbols A, G in Table 1, the rolling is carried out by variously changing tandem rolling conditions. Then, Epstein test pieces in L-, C- and D-directions for the evaluation of materials are sampled from the product sheets obtained after the recrystallization annealing at 880° C. and the coating treatment to measure magnetic properties. And also, DC brushless motors of 300 W are prepared to measure their motor efficiencies.

Moreover, the tandem rolling mill consists of four stands, wherein rolling temperature and rolling reduction are shown with respect to a stand having a highest entry side temperature.

Furthermore, the hardness $Hv_1$ (JIS Z2244, test load: 9.807 N) of each product sheet is measured.

The measured results on the material properties and motor efficiency are shown in Table 3, and the measured values of the hardness are shown in Table 4, respectively.

TABLE 3

| Steel symbol | Rolling temperature (° C.) | Rolling reduction (%) | $W_{15/50}$ (L + C) (W/kg) | 0.03 × $W_{15/50}$ (L + C) +1.63 | $B_{50}$ (L + C) (T) | $W_{10/400}$ (L + C) (W/kg) | $W_{10/400}$ (D) (W/kg) | W (D)/ W (L + C) | Motor efficiency (%) | Remarks |
|---|---|---|---|---|---|---|---|---|---|---|
| A | 30 | 30 | 2.34 | 1.700 | 1.715 | 19.2 | 23.5 | 1.22 | 88.7 | Comparative Example |
| " | 55 | 10 | 2.20 | 1.696 | 1.682 | 19.5 | 24.6 | 1.26 | 88.9 | Comparative Example |
| " | 60 | 25 | 2.34 | 1.700 | 1.742 | 18.5 | 19.5 | 1.05 | 94.1 | Invention Example |
| " | 83 | 33 | 2.09 | 1.693 | 1.749 | 18.4 | 18.4 | 1.00 | 94.8 | Invention Example |
| " | 154 | 28 | 2.11 | 1.693 | 1.761 | 17.5 | 19.0 | 1.09 | 94.9 | Invention Example |
| " | 256 | 25 | 2.25 | 1.698 | 1.755 | 19.1 | 19.5 | 1.02 | 94.8 | Invention Example |
| G | 81 | 35 | 2.01 | 1.690 | 1.723 | 15.2 | 16.5 | 1.09 | 93.3 | Invention Example |
| " | 165 | 21 | 1.95 | 1.689 | 1.724 | 16.2 | 16.5 | 1.02 | 93.2 | Invention Example |
| " | 238 | 24 | 1.87 | 1.686 | 1.731 | 14.9 | 15.3 | 1.03 | 93.7 | Invention Example |

TABLE 4

| Steel symbol | $Hv_1$ | $-83.3 \times W_{15/50}$ (L + C) + 380 | Degrading ratio of $W_{15/50}$(L + C) (%) | Remarks |
|---|---|---|---|---|
| A | 160 | 185 | 9.1 | Comparative Example |
| A | 159 | 197 | 7.8 | Comparative Example |
| A | 162 | 185 | 8.8 | Invention Example |
| A | 161 | 205 | 6.5 | Invention Example |
| A | 162 | 204 | 6.7 | Invention Example |
| A | 160 | 192 | 7.3 | Invention Example |
| G | 208 | 212 | 9.3 | Invention Example |
| G | 202 | 217 | 8.9 | Invention Example |
| G | 204 | 224 | 8.5 | Invention Example |

As seen from Tables 3 and 4, all of the steel sheets according to the invention are small in the magnetic anisotropy in a high frequency zone and indicate good motor properties and have an adequate hardness and are excellent in the press formability.

INDUSTRIAL APPLICABILITY

According to the invention, nonoriented electromagnetic steel sheets being small in the magnetic anisotropy in a high frequency zone and excellent in the magnetic properties as a rotating machine and having an excellent press formability such as punching property or the like can be obtained stably.

What is claimed is:

1. A nonoriented electromagnetic steel sheet having a small magnetic anisotropy in a high frequency zone and an excellent press formability comprising:

C: not more than 0.0050 mass %;

Si: 0.5–4.5 mass %;

Mn: 0.1–2.5 mass %;

Al: 0.2–2.5 mass %; and controlling S: not more than 0.01 mass %, wherein the sheet has magnetic properties in a rolling direction (L-direction), a direction perpendicular to the rolling direction (C-direction) and a direction inclined at an angle of 45° with respect to the rolling direction (D-direction) using an Epstein test piece, and wherein average iron loss in the L and C directions ($W_{15/50}$(L+C)) in W/kg at 1.5 T and 50 Hz and average magnetic flux density in the L and C directions ($B_{50}$(L+C)) in T at 5000 A/m satisfy the following equation (1):

$$B_{50}(L+C) \geqq 0.03 \cdot W_{15/50}(L+C) + 1.63 \quad (1)$$

and a ratio of iron loss in the D direction ($W_{10/400}$ (D)) to average iron loss in the L and C directions ($W_{10/400}$(L+C)) at 1.0 T and 400 Hz satisfies the following equation (2):

$$W_{10/400}(D)/W_{10/400}(L+C) \leqq 1.2 \quad (2).$$

2. The nonoriented electromagnetic steel sheet according to claim 1, wherein the hardness of the steel sheet is limited to not more than the maximum value defined in accordance with a sheet thickness and $W_{15/50}$(L+C).

3. The nonoriented electromagnetic steel sheet according to claim 2, wherein the hardness of the steel sheet $Hv_1$ satisfies the following equation (3):

$$Hv_1 \leqq -83.3 \cdot W_{15/50}(L+C) + 380 \quad (3)$$

within a range of iron loss of $W_{15/50}$(L+C)≦5.0 W/kg and at a sheet thickness of 0.35 mm±0.02 mm.

4. The nonoriented electromagnetic steel sheet according to claim 2, wherein the hardness of the steel sheet $Hv_1$ satisfies the following equation (4):

$$Hv_1 \leqq -63.6 \cdot W_{15/50}(L+C) + 360 \quad (4)$$

within a range of iron loss $W_{15/50}$(L+C)≦5.0 W/kg and at a sheet thickness of 0.50 mm±0.02 mm.

5. The nonoriented electromagnetic steel sheet according to any one of claims 1–4, wherein the steel sheet further contains Sb: 0.005–0.12 mass %.

* * * * *